US008944630B2

(12) United States Patent
Leineweber et al.

(10) Patent No.: US 8,944,630 B2
(45) Date of Patent: Feb. 3, 2015

(54) LINEAR LAMP

(75) Inventors: Werner Leineweber, Wipperfürth (DE); Friedbert Schacherer, Wipperfürth (DE)

(73) Assignee: Osram GmbH, Munich (DE)

( * ) Notice: Subject to any disclaimer, the term of this patent is extended or adjusted under 35 U.S.C. 154(b) by 270 days.

(21) Appl. No.: 13/512,498

(22) PCT Filed: Nov. 25, 2010

(86) PCT No.: PCT/EP2010/068232

§ 371 (c)(1), (2), (4) Date: May 29, 2012

(87) PCT Pub. No.: WO2011/064305

PCT Pub. Date: Jun. 3, 2011

(65) Prior Publication Data

US 2012/0236552 A1 Sep. 20, 2012

(30) Foreign Application Priority Data

Nov. 26, 2009 (DE) ..... 10 2009 055 855

(51) Int. Cl.

| | |
|---|---|
| ***F21V 21/00*** | (2006.01) |
| ***F21V 7/00*** | (2006.01) |
| ***F21K 99/00*** | (2010.01) |
| *F21Y 101/02* | (2006.01) |
| *F21Y 103/00* | (2006.01) |

(52) U.S. Cl.

CPC ... *F21K 9/00* (2013.01); *F21K 9/17* (2013.01); *F21Y 2101/02* (2013.01); *F21Y 2103/00* (2013.01); *F21Y 2103/003* (2013.01)

USPC ..... 362/217.14; 362/217.01; 362/217.1; 362/225; 362/249.02

(58) Field of Classification Search

CPC ..... F21V 19/004; F21V 17/04; F21V 17/06; F21V 17/162; F21V 17/164; F21V 17/166; F21V 17/10; F21V 21/00; F21V 21/088; F21V 21/108; F21V 23/009

USPC ..... 362/217.16, 218, 219, 221, 225, 362/249.02, 217.01–217.09; 313/261

See application file for complete search history.

(56) References Cited

U.S. PATENT DOCUMENTS

| | | | | |
|---|---|---|---|---|
| 5,463,280 | A | 10/1995 | Johnson | |
| 8,313,213 | B2 * | 11/2012 | Lin et al. | 362/225 |
| 8,408,734 | B2 * | 4/2013 | Wu et al. | 362/218 |
| 2002/0060526 | A1 | 5/2002 | Timmermans et al. | |
| 2002/0114155 | A1 * | 8/2002 | Katogi et al. | 362/219 |
| 2003/0076026 | A1 * | 4/2003 | Trent et al. | 313/332 |
| 2004/0179357 | A1 * | 9/2004 | Kappe | 362/222 |
| 2005/0265019 | A1 * | 12/2005 | Sommers et al. | 362/217 |

(Continued)

FOREIGN PATENT DOCUMENTS

| | | |
|---|---|---|
| DE | 1 919 505 | 10/1970 |
| DE | 87 05 381 | 5/1987 |

(Continued)

*Primary Examiner* — Jong-Suk (James) Lee
*Assistant Examiner* — Zheng Song
(74) *Attorney, Agent, or Firm* — Cozen O'Connor

(57) ABSTRACT

A linear lamp having a longitudinal bulb, in particular a glass bulb, wherein at least one socket is provided for electrical contacting and mounting of the linear lamp, and wherein at least one light-emitting diode is disposed in the bulb as a luminous element.

12 Claims, 5 Drawing Sheets

(56) References Cited

U.S. PATENT DOCUMENTS

| | | | | |
|---|---|---|---|---|
| 2006/0215422 | A1 | 9/2006 | Laizure et al. | |
| 2008/0037239 | A1* | 2/2008 | Thomas et al. | 362/92 |
| 2008/0094837 | A1* | 4/2008 | Dobbins et al. | 362/249 |
| 2009/0027916 | A1 | 1/2009 | Huang et al. | |
| 2009/0296381 | A1* | 12/2009 | Dubord | 362/218 |
| 2010/0008085 | A1* | 1/2010 | Ivey et al. | 362/218 |
| 2011/0090682 | A1* | 4/2011 | Zheng et al. | 362/218 |
| 2011/0175536 | A1* | 7/2011 | Fujita et al. | 315/185 R |
| 2012/0212953 | A1* | 8/2012 | Bloom et al. | 362/223 |
| 2012/0262913 | A1* | 10/2012 | Chi et al. | 362/221 |

FOREIGN PATENT DOCUMENTS

| | | |
|---|---|---|
| DE | 100 24 427 | 12/2001 |
| DE | 20 2007 017 882 | 4/2008 |
| DE | 10 2007 033 893 | 1/2009 |
| EP | 1 156 272 | 11/2001 |
| WO | WO 02/49075 | 6/2002 |
| WO | WO 2010/005796 | 1/2010 |

* cited by examiner

LINEAR LAMP

RELATED APPLICATIONS

This is a U.S. National Phase Application under 35 USC 371 of International Application PCT/EP2010/068232 filed on Nov. 25, 2010.

This application claims the priority of German Application No. 10 2009 055 855.1 filed Nov. 26, 2009, the entire content of which is hereby incorporated by reference.

FIELD OF THE INVENTION

The invention relates to a linear lamp having a tubular bulb made of glass.

BACKGROUND OF THE INVENTION

Document DE 1 919 505 U discloses a linear lamp of this kind. This is a lamp of the type 'Linestra' made by the company Osram. In this case, the linear lamp comprises a longitudinal glass bulb incorporating a spiral-wound filament extending approximately along a longitudinal axis of the glass bulb. The spiral-wound filament is contacted by means of two sockets disposed radially on the glass bulb which are simultaneously used to mount the linear lamp in a lamp holder.

The drawback of this solution is that a linear lamp of this type has high energy consumption. As a result, from 2013, it will no longer be permitted according to the European Union's EuP Directive (Energy-Using Products) or Eco-Design Directive 2005/32/EC.

SUMMARY OF THE INVENTION

It is an object of the present invention to provide a linear lamp having low energy consumption and substantially the same luminous characteristics as those of conventional linear lamps.

According to one aspect of the invention, a linear lamp comprises a longitudinal bulb, in particular a glass bulb. At least one socket is provided for the electrical contacting and mounting of the linear lamp. At least one light-emitting diode is disposed in the bulb as a luminous element.

This solution has the advantage that a linear lamp of this kind has extremely low energy consumption compared to the prior art mentioned in the introduction. In addition, advantageously, the at least one light-emitting diode can achieve substantially the same radiation characteristics as those of conventional linear lamps with a spiral-wound filament.

The socket is preferably disposed radially on a side facing away from the main direction of radiation of the light-emitting diode.

Advantageously, the at least one light-emitting diode is disposed on a printed circuit board, in particular an FR4 board, housed in the bulb. The printed circuit board enables simple contacting and mounting of the light-emitting diode.

Preferably, the printed circuit board is longitudinal and hence matched to the longitudinal bulb of the linear lamp. As a result, the printed circuit board provides a large surface for a plurality of light-emitting diodes. The plurality of light-emitting diodes facilitates high luminosity of the linear lamp and permits more precise adaptation to the radiation characteristics of a conventional linear lamp.

To achieve higher heat removal from the light-emitting diodes or better cooling of the light-emitting diodes, the bulb is filled with a filling gas, in particular helium, having good heat-conducting properties.

To avoid shadowing inside the linear lamp, the light-emitting diodes can be disposed on a diode side of the printed circuit board.

The electronic components for powering and controlling the light-emitting diodes are then advantageously disposed on a lower side of the printed circuit board facing away from the diode side.

The electronic components for powering and controlling the light-emitting diodes in particular comprise at least one linear longitudinal controller. This enables the achievement of a driver with a particularly simple and compact, in particular flat, design for the light-emitting diodes enabling the external dimensions of conventional linear lamps to be retained and the light distribution of conventional linear lamps to be emulated particularly successfully.

To achieve good illumination of the bulb of the linear lamp, compared to the diode side of the printed circuit board, the lower side is disposed closer to an inner lateral surface of the bulb.

In order to protect the light-emitting diodes from high temperatures during the production and use of the linear lamps, at least one heat sink, in particular a plate, in particular a Cu plate, is provided in the bulb.

The at least one heat sink of this kind can be embodied with low technical complexity such that the printed circuit board is held thereby.

For effective heat removal, a plate is disposed at each end section of the printed circuit board. This is in particular of advantage during the sealing-in of the printed circuit board in the glass bulb.

The plate is preferably bent, in particular in an end region of the printed circuit board. This can achieve good adaptation to the contour of the printed circuit board.

In particular, the bent plate comprises a holding limb disposed on the lower side of the printed circuit board and fastened thereto and a plate limb disposed approximately at a parallel distance to a transverse edge of the printed circuit board.

At its longitudinal edges, the holding limb has at least two projecting holding arms by means of which the holding limb can be clamped to the printed circuit board and wherein, in particular for mounting the printed circuit board, the holding arms are supported on an inner lateral surface of the bulb.

Preferably, a support arm is embodied on the holding limb on a transverse edge pointing away from the plate limb, said support being disposed such that, together with the at least two holding arms, it holds the printed circuit board in the bulb. This provides inexpensive and technically simple mounting of the printed circuit board.

The support arm can comprise a V section with an opening in the section approximately tapering toward the printed circuit board through which a power supply for the printed circuit board can be guided. This is fixed through the opening in a displacement direction away from the printed circuit board.

In one embodiment of the invention, at least one spacer is disposed on the lower side of the printed circuit board. This ensures that the printed circuit board is spaced apart from the outer wall. The spacer is preferably embodied as a plate bending part and can also be used for heat removal. Moreover, the spacer can be bonded to the printed circuit board and be used for the mounting of the printed circuit board.

In an advantageous further development of the invention, the light-emitting diodes are disposed in at least one row extending approximately in parallel to the longitudinal axis of the lamp thus achieving uniform radiation characteristics of the linear lamp.

The light-emitting diodes can also be disposed in two rows extending at a parallel distance to each other thus achieving better cooling of the light-emitting diodes compared to non-spaced-apart rows.

The bulb can be coated in order to achieve a pleasing aesthetic appearance.

The linear lamp is inexpensive to produce if the bulb has a comparatively low filling gas pressure.

In an advantageous further development of the invention, a luminous material is applied as a coating at least in sections to an inner bulb surface or an outer bulb surface of the bulb.

The light-emitting diodes can have different luminous colors and color temperatures, wherein in particular the luminous color is implemented by controllable LED bands, in particular RGB bands. The LED bands can, for example, be light-emitting diodes disposed on a carrier foil, wherein they emit cool white, warm white, blue, red, green or RGB light.

DETAILED DESCRIPTION OF THE DRAWINGS

Figure 1:
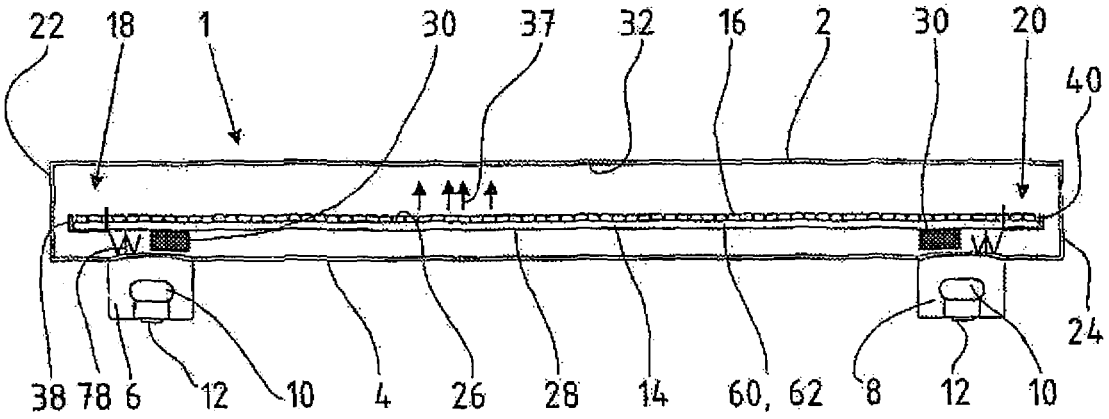
FIG. 1 shows a schematic longitudinal section view of a linear lamp according to an exemplary embodiment.

FIG. 1 is a schematic longitudinal section view of an exemplary embodiment of a linear lamp 1 according to the invention. Previous linear lamps in the prior art comprise a spiral-wound filament resulting in high energy consumption. Types of linear lamps with spiral-wound filaments are, for example, Linestra from OSRAM, Philinea from Philips and Ralina from Radium. Linear lamps are used, for example, in living spaces, such as bathrooms or kitchens or as batten luminaires in cupboards.

The linear lamp 1 from FIG. 1 has a tubular longitudinal bulb 2. This is made of glass, which, advantageously, substantially does not experience any ageing effect due to exposure to external or internal radiation (UV resistance). Sockets 6, 8, which are spaced apart from each other in the longitudinal direction of the linear lamp 1, project from an outer lateral surface 4 of the bulb 2 or glass bulb approximately in the same radial direction. Said sockets enable the linear lamp 1 to be used in a holder in a conventional luminaire for linear lamps and electrically contacted. In FIG. 1, the sockets 6, 8 each comprise a recess 10 on their front and rear sides by means of which they are gripped from behind by a corresponding element of a holding fixture of the luminaire for mounting. Contact lugs 12 are embodied on a lower side of the socket 6, 8 in FIG. 1 for electrical contacting. The above-described embodiment of the linear lamp 1 preferably conforms to a standard.

Inside the bulb 2, a longitudinal printed circuit board 14 with a plurality of light-emitting diodes or LEDs 16 (to simplify matters, only one single LED has been given a reference number) is used. The printed circuit board 14 is an FR4 board, which is held by the fixing means explained below. For better heat removal, the printed circuit board 14 can be made of a material with good heat conductivity such as aluminum or ceramic, at least in sections, although this does result in higher costs. An axial length of the printed circuit board 14 is slightly shorter than an axial length of the bulb 2 causing end sections 18, 20 of the printed circuit board 16 to be spaced apart from a respective end face 22 or 24 of the bulb 2.

The LEDs 16 extend from a diode side 26 of the printed circuit board 14 pointing away from the sockets 6, 8 in a fixed row one behind the other approximately parallel to the longitudinal direction. Electronic components or electronic elements 30, of which two are shown by way of example in FIG. 1, for powering and controlling the LEDs 16 are disposed on a lower side 28 of the printed circuit board 14 facing away from the diode side 26.

Figure 2:
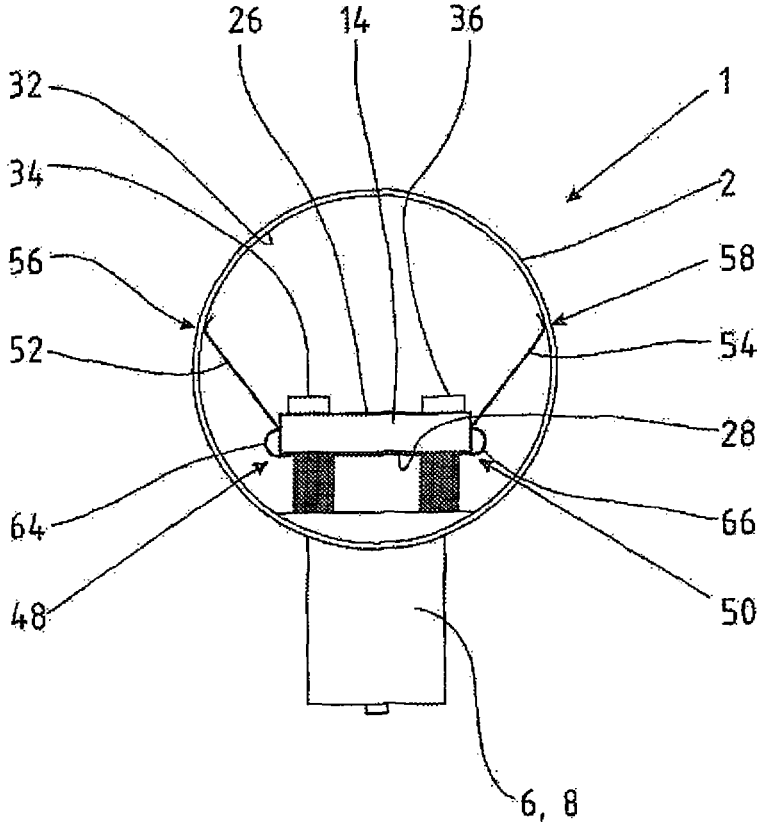
FIG. 2 shows a schematic cross-sectional view of the linear lamp from FIG. 1.

FIG. 2 shows the linear lamp 1 in a schematically enlarged cross-sectional view with a cutting plane through the plate 40 from FIG. 1. A distance between the diode side 26 of the printed circuit board 14 and an inner lateral surface 32 of the bulb 2 is greater than the distance between the lower side 28 and the inner lateral surface 32 of the bulb 2, wherein the distance is in each case measured in an approximately orthogonal direction to the printed circuit board 14. A distance between the longitudinal edges of the printed circuit board 14 and the inner lateral surface 32 is approximately the same and this also applies to the distance between the transverse edges and the end faces 22, 24 from FIG. 1. A width of the printed circuit board 14 in FIG. 2 approximately corresponds to the width of the sockets 6, 8. Two diode rows 34, 36 extending approximately at a parallel distance to each other are embodied on the diode side 26 of the printed circuit board 14. The spacing apart of the diode rows 34, 36 permits high heat transfer from the LEDs 16, see FIG. 1. It is also conceivable, instead of two diode rows 34, 36, for there to be only one diode row or more than two diode rows. The parallel distance of the diode rows 34, 36 and the printed circuit board 14, which is offset from a longitudinal axis of the bulb 2 in the direction of the sockets 6, 8, also provides large-area illumination of the bulb 2 by the LEDs 16.

In FIG. 1, the bulb 2 is filled with helium as a filling gas with good heat conductivity with a comparatively low filling pressure. A low filling gas pressure is advantageous from the point of view of production technology and results in low costs. When the linear lamp 1 is in use, the filling gas with good heat conductivity enables a large amount of heat to be removed from the LEDs 16 and also from the electronic elements 30 to the bulb 2 for cooling and the bulb can release the heat into the environment. In FIG. 1, the heat flow is indicated by way of example by arrows 37. In addition, the large areas of the printed circuit board 14 and of the bulb 2 provide large heat transfer areas to the filling gas.

Figure 3:
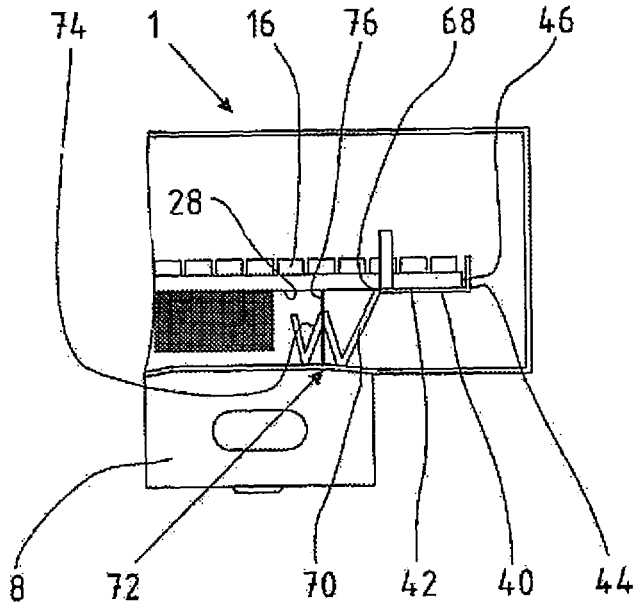
FIG. 3 shows an enlarged detail of an end section of the linear lamp from FIG. 1.

During the production of the linear lamp 1, the glass bulb 2 is melted around the printed circuit board 14, which is spaced apart from the bulb 2, resulting in temperatures of approximately 1000° C. To protect the LEDs 16 and the electronic elements 30 from the high temperatures, heat traps or heat sinks made of an inexpensive copper plate 38, 40 are disposed at the end sections 18, 20 of the printed circuit board 14. The highest temperatures occur in these areas during production. The design of the plates 38, 40 is described in more detail below in FIG. 3. In addition, while the bulb 2 is being melted around the printed circuit board 14, active air cooling takes place—this is not explained in any further detail. FIG. 3 shows an enlarged detail of a right end section of the linear lamp 1 from FIG. 1 with the plate 40. This is bent approximately at a right angle and has a holding limb 42 fixed approximately parallel to the lower side 28 of the printed circuit board 14. A further plate limb 44 extends upward approximately at a parallel distance from a transverse edge 47 of the printed circuit board 14 in FIG. 3. Due to this embodiment and arrangement, the plate 40 creates virtually no shadowing or no shadowing at all during the use of the linear lamp 1 and provides a large heat transfer surface to the surrounding gas.

In addition, holding arms 52 or 54 pointing away from the socket 6, 8 project from a respective longitudinal edge 48 and 50, see FIG. 2, of the holding limb 42 of the plate 40 in the direction of inner lateral surface 32 of the bulb 2. The holding arms 50 and 52 are disposed in a V shape with respect to each other and are each supported by their end section 56 or 58 pointing away from the plate 40 on the inner lateral surface 32 of the bulb 2. In the region of the longitudinal edges 60, 62, see FIG. 1, of the printed circuit board 14, the holding arms 50 and 52 are bent with a radius in such a way that in each case an arc section 64 or 66 is formed which is concave on its side pointing in the direction toward the printed circuit board 14. In the transitional area from the arc section 64 and 66 to the holding arm 50 or 52, which extends substantially straight, these each lie on the respective longitudinal edges 60, 62 of the printed circuit board 14 and exert a locking force on the printed circuit board 14 due to the fact that the arc sections 64, 66 function as springs. The plate 40 is hence connected to the printed circuit board 14 by means of the holding arms 52, 54 by a non-positive, positive or material fit.

At a transverse edge 68 of the holding limb 42 pointing away from the plate limb 44, there is a support arm 70 extending from the lower side 28 of the printed circuit board 14 and supported on the inner lateral surface 32 of the bulb 2. Since the design of the plate 38 corresponds to that of the plate 40, the printed circuit board 14 is secured by means of the end sections 18 and 20 of the plates 38 or 40 by means of their respective holding arms 52, 54 and their respective support arm 70 inside the bulb 2.

At its end section 72 pointing away from the printed circuit board 14, the support arm 70 of the plates 38 and 40, see FIG. 3, is approximately W-shaped thus forming a V section 74 pointing toward the printed circuit board 14. This is in each case disposed in the area of the socket 6, 8. A power supply 76 used for the contacting extending from the socket 8 in FIG. 3 to the printed circuit board 14 is guided through an opening (not shown) in the bent area of the V section 74. Here, the opening is designed such that, in a displacement direction away from the printed circuit board 14, the power supply 76 is blocked by the opening of the V section 74 and can only be moved through the opening in the direction of the printed circuit board 14. Hence, the V section 74 is embodied as a type of insulating piercing connecting device. The left-hand plate 38 in FIG. 1 is embodied in the same way and so a power supply 78 is also fixed by this.

Figure 4:
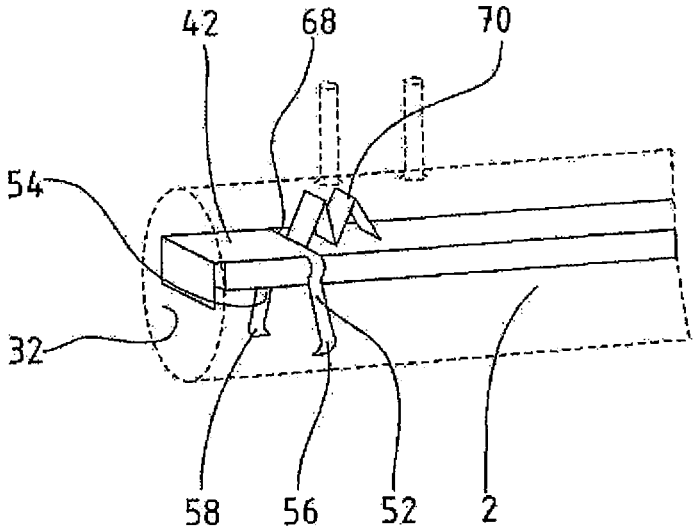
FIG. 4 shows a perspective inverted view of the end section from FIG. 3.

FIG. 4 is a perspective inverted view of the end section 20 of the linear lamp 1 shown in FIG. 3. The end sections 56, 58 of the holding arms 52, 54 are slightly bent so that the end sections 56, 58 lie, with an approximately convex surface, at least in sections on the inner lateral surface 32.

The width of the support arm 70 approximately corresponds to half the width of the transverse edge 68 of the holding limb 42. Here, the support arm 70 is approximately in the middle of transverse edge 68. The width of the holding arms 52, 54 approximately corresponds to that of the support arm 70, wherein these extend approximately from an end region of the longitudinal edges 48, 50, see FIG. 2, adjacent to the transverse edge 68.

It is conceivable for the plates 38, 40 to be embodied as SMD components to simplify their connection to the printed circuit board 14.

The left-hand plate 38 in FIG. 1 is embodied similarly to the plate 40. Additionally to or instead of the plates 38, 40, the printed circuit board 16 can comprise heat-conducting materials, although this would entail higher costs in both cases. In each case, heat sinks can be dispensed with in the case of the linear lamp 1 according to the invention thus resulting in a low weight.

Figure 5:
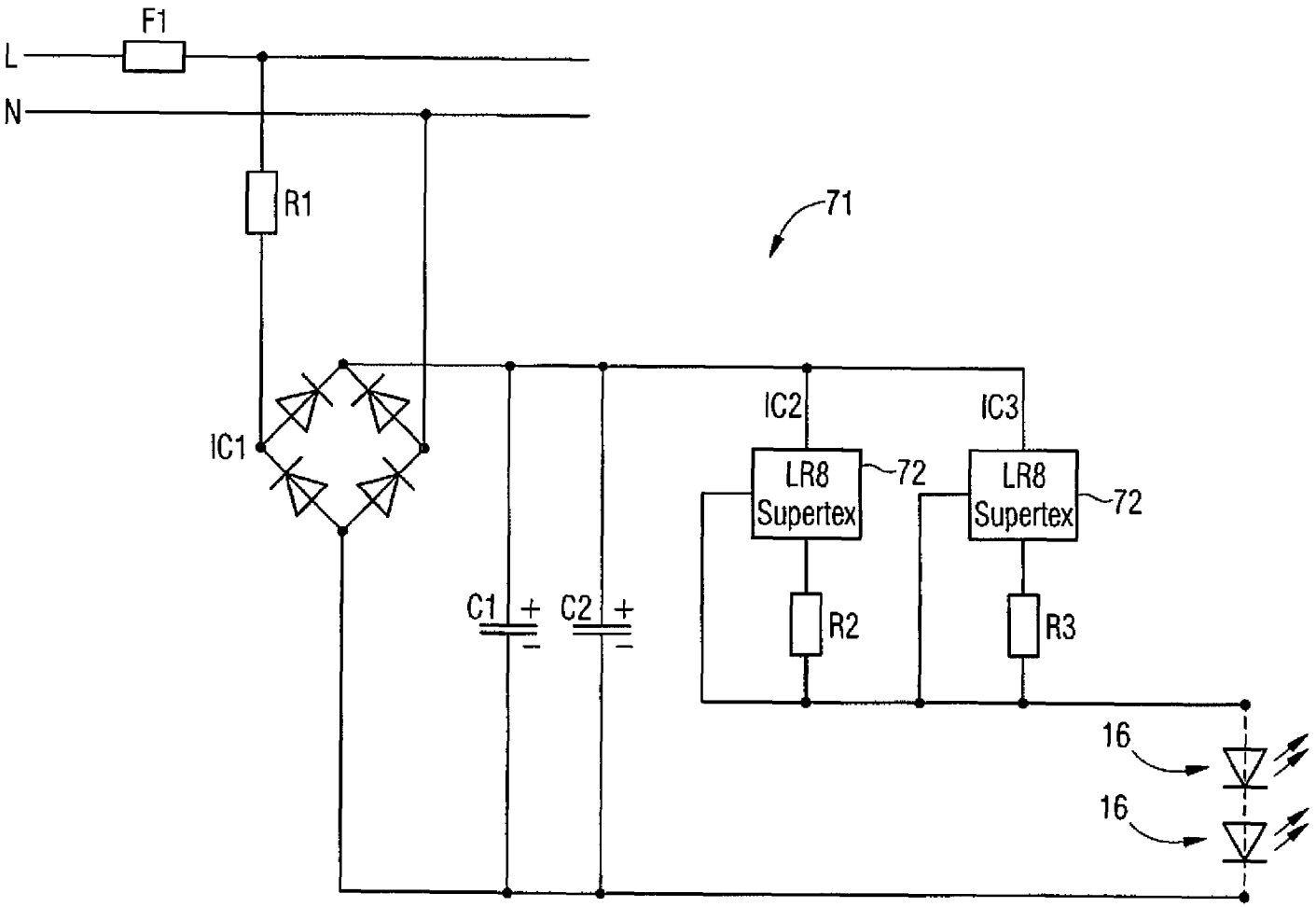
FIG. 5 shows a schematic view of the LED driver circuit of a linear lamp according to an embodiment of the invention.

FIG. 5 is a schematic view of the LED driver circuit 71 of a linear lamp 1 according to the invention. For the power supply for the light-emitting diodes 16, the circuit comprises two linear longitudinal controllers 72 connected in parallel permitting a simple, flat and compact design. However, other embodiments are also conceivable, in particular embodiments with only one linear longitudinal controller. The arrangement shown is also characterized by good EMV properties.

Figure 6:
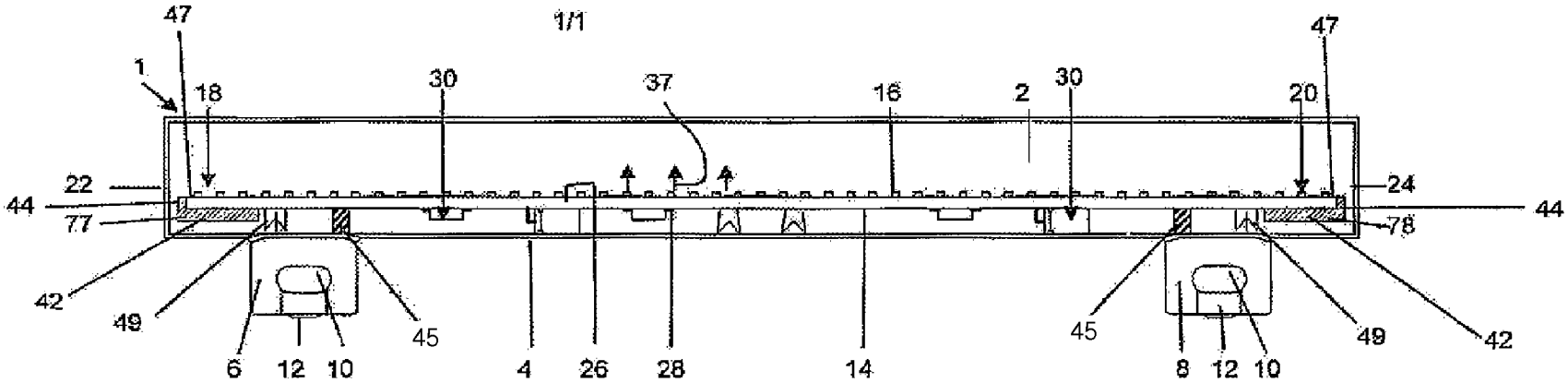
FIG. 6 shows a schematic longitudinal section view of a linear lamp according to a further exemplary embodiment.

FIG. 6 is a schematic longitudinal section view of a linear lamp'according to a further exemplary embodiment. The principal structure of the linear lamp 1 is similar to that in FIG. 1 and has a tubular longitudinal bulb 2 made of glass. Sockets 6, 8, which are spaced apart from each other in the longitudinal direction of the linear lamp 1, project from an outer lateral surface 4 of the bulb 2 or glass bulb approximately in the same radial direction. Said sockets enable the linear lamp 1 to be received in a holder of a conventional luminaire suitable for linear lamps and electrically contacted. In FIG. 1, the sockets 6, 8 each comprise a recess 10 on their front and rear sides, by means of which they are gripped from behind by a corresponding element of a holding fixture of the luminaire for mounting. In FIG. 1, contact lugs 12 are provided on a lower side of the socket 6, 8 for electrical contacting. The above-described embodiment of the linear lamp 1 preferably conforms to a standard.

Similarly to FIGS. 1 to 3, inside the bulb 2, a longitudinal printed circuit board 14 with a plurality of light-emitting diodes or LEDs 16 (to simplify matters, only one single LED has been given a reference number) is used. An axial length of the printed circuit board 14 is slightly shorter than an axial length of the bulb 2 causing end sections 18, 20 of the printed circuit board 16 to be spaced apart from a respective end face 22 or 24 of the bulb 2.

The LEDs 16 extend from a diode side 26 of the printed circuit board 14 pointing away from the sockets 6, 8 in a fixed row one behind the other approximately parallel to the longitudinal direction. Electronic components or electronic elements 30, of which two are shown by way of example in FIG. 6, for powering and controlling the LEDs 16 are disposed on a lower side 28 of the printed circuit boards 14 facing away from the diode side 26.

The printed circuit board 14 is fixed by means of two spacers 45 in the glass bulb 2 for which the spacer 45 is bonded to the printed circuit board 14 and the glass bulb 2. The electrical contacting is provided by contacting devices 49 embodied as plate bending parts. In the end region.

The bulb 2 is filled with helium as a filling gas with good heat conductivity with a comparatively low filling pressure. Hence, the heat flow takes place in the way indicated by way of example by arrows 37. In addition, the large areas of the printed circuit board 14 and of the bulb 2 provide large heat transfer areas to the filling gas.

The production of the linear lamp 1 is performed as described above, i.e. the glass bulb 2 is melted around the printed circuit board 14, which is spaced apart from the bulb 2. To protect the LEDs 16 and the electronic elements 30 from the high temperatures, heat traps or heat sinks made of an inexpensive copper plate 77, 78 are disposed at the end sections 18, 20 of the printed circuit board 14. The highest temperatures occur in these areas during production. The plates 77, 78 are bent approximately at a right angle and have a holding limb 42 fixed approximately parallel to the lower side 28 of the printed circuit board 14. A plate limb 44 extends upward approximately at a parallel distance from a transverse edge 47 of the printed circuit board 14. Due to this embodiment and arrangement, the plates 77, 78 create virtually no shadowing or no shadowing at all during the use of the linear lamp 1 and provide a large heat transfer surface to the surrounding gas.

Figure 7:
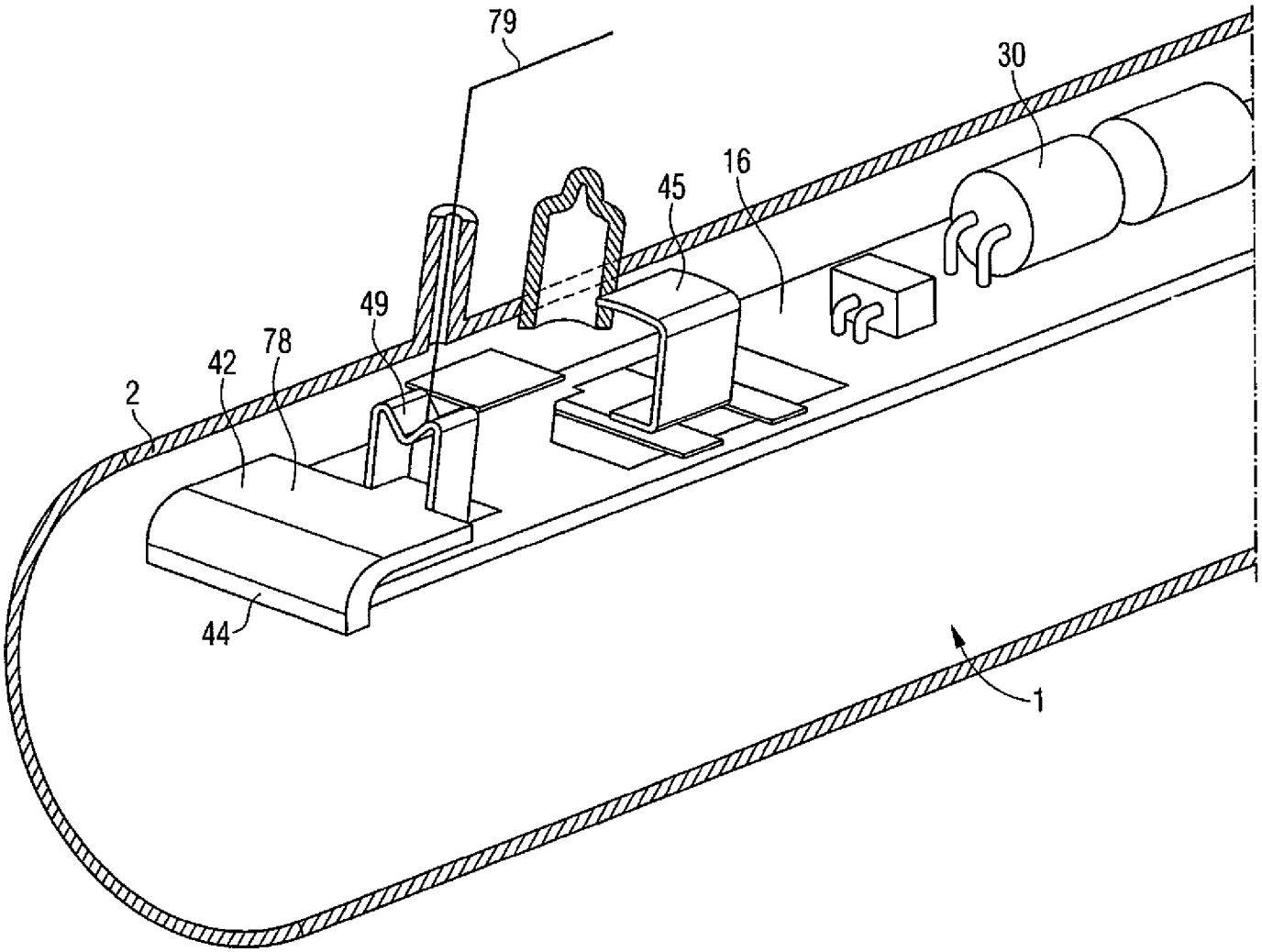
FIG. 7 shows a perspective inverted view of the right end section from FIG. 6.

FIG. 7 is a perspective inverted view of the right end section from FIG. 6. The plate 77, the spacer 45 and the contacting devices 49 are secured to the printed circuit board. The contacting device 49 comprises a bent plate with a V-shaped receiver for a contact wire 79. The spacer 45 is formed from a U-shaped bent plate and bonded to the bulb 2. Each of these components is a plate bending component and can therefore advantageously be used for heat removal. It is conceivable for the plates 77, 78 and the spacer 45 and the contacting devices 49 to be embodied as SMD components to simplify their connection to the printed circuit board 14. This enables the heat to be removed from the printed circuit board 14 particularly effectively. In this exemplary embodiment, the width of the plates 77, 78 approximately corresponds to the width of the printed circuit board 14 thus permitting particularly simple handling together with good heat removal. However, also conceivable are embodiments in which the width of the plates 77, 78 is greater than the width of the printed circuit board 14, which improves heat removal, or embodiments in which the width of the plates 77, 78 is smaller than the width of the printed circuit board 14, which improves handling.

The left-hand plate 77 in FIG. 6 corresponds to the plate 78. Additionally to or instead of the plates 77, 78, the printed circuit board 14 can comprise thermally conductive materials, but this would result in higher costs in both cases. In each case, heat sinks can be dispensed in the case of the linear lamp 1 according to the invention, thus resulting in a low weight.

The glass bulb 2 is characterized by a more pleasing aesthetic appearance than a plastic bulb. Coating of the bulb 2 enables the aesthetic appearance to be further improved and the luminous characteristics and the radiation characteristics of the linear lamp 1 to be changed. In addition, glass has better light transmission than plastic.

It is conceivable to embody the LEDs 16 without a housing.

In deviation from the exemplary embodiment, the LEDs 16 can be disposed in any way desired. It is also possible to provide different luminous colors and color temperatures (for example multicolored linear lamps 1).

The linear lamp 1 has, for example, a lamp wattage (without a driver) of between 4 and 5 W and a luminous flux of between 250 and 280 lm, wherein a luminous flux of this kind corresponds to that of a conventional linear lamp with a spiral-wound filament.

The invention discloses a linear lamp having a tubular bulb made of glass. At least one socket is provided for the electrical contacting and mounting of the linear lamp. At least one light-emitting diode is disposed in the bulb as a luminous element. It can also be advantageous for the sockets to be disposed at one or both ends, in particular at right angles to the main radiation direction of the glass bulb.

What is claimed is:

1. A linear lamp comprising:

a longitudinal glass bulb;

at least one socket provided for electrically contacting and mounting of the linear lamp;

a longitudinal printed circuit board housed within the glass bulb;

at least one light-emitting diode disposed on an upper diode side of the printed circuit board; and at least two heat sinks, each heat sink being disposed at a longitudinal end section of the printed circuit board and within the glass bulb, each heat sink comprising a holding limb disposed on a lower side of the printed circuit board and fixed to the printed circuit board, the holding limb comprising:

at least two projecting holding arms attached to side edges of the holding limb, the at least two holding arms clamping the printed circuit board in position within the glass bulb and supported against an inner lateral surface of the glass bulb, and a support arm attached to a transverse edge of the holding limb, the support arm clamping the printed circuit board in position within the glass bulb and supported against an inner bottom surface of the glass bulb.

2. The linear lamp of claim 1, wherein the glass bulb is filled with a filling gas.

3. The linear lamp of claim 2, wherein the filling gas is helium.

4. The linear lamp of claim 1, further comprising electronic components for powering and controlling the light-emitting diodes, the electronic components being disposed on the lower side of the printed circuit board.

5. The linear lamp of claim 4, wherein, compared to the diode side, the lower side is disposed closer to the inner bottom surface of the glass bulb.

6. The linear lamp of claim 1, wherein the support arm comprises a V section with an opening embodied in a section approximately tapering toward the printed circuit board through which a power supply for the printed circuit board can be guided and is fixed in a displacement direction away from the printed circuit board through the opening.

7. The linear lamp of claim 1, wherein the light-emitting diodes are disposed in at least one diode row extending parallel to the longitudinal axis of the lamp.

8. The linear lamp of claim 7, wherein two diode rows extending at parallel distance to each other are provided.

9. The linear lamp of claim 1, wherein the glass bulb is coated.

10. The linear lamp of claim 1, wherein a luminous material is applied as a coating at least in sections to the inside surface or an outside surface of the glass bulb.

11. The linear lamp of claim 1, wherein the light-emitting diodes have different luminous colors and color temperatures, wherein the luminous color is implemented by controllable LED bands.

12. The linear lamp of claim 1, wherein the at least two heat sinks are made of copper.

* * * * *